US006726452B2

(12) United States Patent
Strassberger et al.

(10) Patent No.: US 6,726,452 B2
(45) Date of Patent: Apr. 27, 2004

(54) TURBINE BLADE ARRANGEMENT

(75) Inventors: Michael Strassberger, München (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/203,388

(22) PCT Filed: Jan. 29, 2001

(86) PCT No.: PCT/EP01/00932

§ 371 (c)(1),
(2), (4) Date: Aug. 9, 2002

(87) PCT Pub. No.: WO01/59263

PCT Pub. Date: Aug. 16, 2001

(65) Prior Publication Data

US 2003/0012654 A1 Jan. 16, 2003

(30) Foreign Application Priority Data

Feb. 9, 2000 (EP) ..... 00102717

(51) Int. Cl.[7] ..... F01D 5/32
(52) U.S. Cl. ..... 416/190; 416/193 A
(58) Field of Search ..... 416/220 R, 193 A, 416/190, 196 R, 221, 241 B

(56) References Cited

U.S. PATENT DOCUMENTS

| | | | |
|---|---|---|---|
| 3,294,364 | A | 12/1966 | Stanley |
| 4,621,979 | A | 11/1986 | Rynaski |
| 4,655,687 | A | 4/1987 | Atkinson |
| 4,802,824 | A | 2/1989 | Gastebois |

FOREIGN PATENT DOCUMENTS

| | | |
|---|---|---|
| DE | 169601 | 12/1904 |
| EP | 0787890 | 8/1997 |
| GB | 811 922 | 4/1959 |
| GB | 2006883 | 5/1979 |
| GB | 2186639 | 8/1987 |

*Primary Examiner*—Edward K. Look
*Assistant Examiner*—Kimya N McCoy
(74) *Attorney, Agent, or Firm*—Harness, Dickey & Pierce, P.L.C.

(57) ABSTRACT

A turbine blade arrangement includes rotating blades respectively provided with a leg which can be respectively inserted into a groove on the outer circumference of a turbine disk in a radial, positive fit and which are respectively provided with a profiled section which has a lateral platform located in an end area on the side of the disk. At least one part of the platform is joined to the turbine disk by way of a retaining element which is independent from the leg of the blades in order to extend the profiled sections of the rotating blades.

21 Claims, 2 Drawing Sheets

TURBINE BLADE ARRANGEMENT

This application is the national phase under 35 U.S.C. § 371 of PCT International Application No. PCT/EPO1/00932 which has an International filing date of Jan. 29, 2001, which designated the United States of America and which claimed priority on German patent application no. 00102717.6 filed Feb. 9, 2000, the entire contents of which are hereby incorporated by reference.

FIELD OF THE INVENTION

The invention generally relates to a turbine blade arrangement with moving blades.

BACKGROUND OF THE INVENTION

To increase the efficiency or the turbine power output and therefore the effective cross section of turbines, conventionally the blade profiles of the turbine moving blades are lengthened, in order thereby to achieve a better utilization of the hot working fluid flowing past or more power output. However, this lengthening of the blade profile is limited by several parameters.

In particular, the lengthened blade profiles and the consequently increased moved mass exert a high load on a hub region of the turbine disk due to the centrifugal force which is applied. Attempts are made to counteract this by increasing the carrying surface in the hub region by way of an axial lengthening of the disk. However, this lengthening possibility is limited. Enlarged blade profiles not only subject the hub to higher load, but also the region in which the turbine blades are inserted with their roots into grooves of the outer circumference of the turbine disk. A lengthening of the blade profiles could also take place in the direction of the disk hub. As a result of this, however, the distance between the grooves of the outer circumference would become smaller and therefore the disk region between them, and, in particular, the groove regions nearest the hub, designated as the root cut, would be subjected to even greater load. At the present time, however, this load is virtually at its maximum possible and can almost no longer be increased, without risking damage to the turbine disk.

SUMMARY OF THE INVENTION

An object of an embodiment of the present invention is, therefore, to provide a turbine blade arrangement which makes it possible to lengthen the moving blade profiles, without an increase or with a merely insignificant increase in the local loads on grooves of the turbine disk or on moving blade roots.

The object may be achieved in at least a part of the platform is connected to the turbine disk by way of a holding device independent of the blade root. By the platform being connected to the turbine disk, at least some of the centrifugal force load caused by the moving blades rotating together with the turbine disk is transferred by the holding device to the turbine disk, to regions located between the root regions. At least some of the centrifugal force load therefore does not have to be absorbed by the blade root or the groove into which the root is inserted and does not have to be transferred to the turbine disk. As a result of load redistribution, therefore, the load is introduced more uniformly into the turbine disk, and the roots of the moving blades and the grooves into which the roots are pushed are relieved of stress excesses which are detrimental to the strength of the regions. This is important particularly in the region of the root cut, imagined as a circle around the hub and running through the lowest groove regions, since the highest stress excesses occur in the lowest groove regions.

Moreover, it is possible for transitional regions between platform and blade to be made appreciably less thick and massive, since the lever forces occurring in this region in a conventional blade due to a projecting platform fastened to the blade are absorbed completely owing to the use of the holding device. The narrow design results, in addition, in a further weight saving. The profiles of the moving blades can therefore be lengthened without an increase or, depending on the amount of lengthening, with a merely insignificant increase in the local loads on disk grooves or moving blade roots. Thus, the efficiency of the turbine can be increased without any adverse influence on the strength of the disk and of the blades.

If the platform part connected to the turbine disk by way of the holding device is produced separately from the moving blade, the holding device absorbs the entire centrifugal force load caused by the platform part. The groove is therefore no longer subjected to load. By the masses of the platform part and of the moving blades, with blade profile and blade root, being separated completely, the centrifugal forces which take effect are absorbed separately by virtue of the respective connection to the turbine disk. The holding device and root therefore have to transfer in each case only a relatively small part of the total centrifugal force load. In the region in which the platform part is separated from the blade, that is to say at edges, it is possible to have a less massive construction of the blade and platform part than in the case of a one-part blade not additionally connected to the turbine disk, since the weight of the platform does not also have to be carried in addition. In this way, therefore, the total weight of the blade is reduced, on the one hand, by the platform being separated and, moreover, by the less massive construction at the edges. The root and the groove thus have to carry even less weight. Moreover, the blades, with the blade profiles, and the separately fastened platform parts are not so easily set in vibration which is critical for the blade fastening, or the vibrations can be damped more easily than in the case of the one-part construction of the blade. Furthermore, the blade and the platform part can be produced separately at a substantially lower outlay. In particular, where the casting of the blade is concerned, the production of the casting mold and exact casting execution are simplified, since the turbine blade without the integrally formed platform virtually no longer has any projecting integral part. The isolated platform part has a simple geometric shape, in general is plate-shaped, and can therefore be produced at a low outlay. Moreover, different materials can be used for the blade and the platform part. As a result, if a relatively light alloy is used, weight and, if appropriate, material costs and machining costs can be saved.

A uniform distribution of the acting centrifugal forces over the circumference of the turbine disk is achieved in that a one-piece platform part is used as a platform part of two adjacent moving blades and the holding device is arranged approximately in the middle between the two adjacent moving blades. The stress peaks, which occur, in particular, below the lowest toothing of the groove due to the high centrifugal force load, are thereby greatly reduced. Since a one-piece platform part is connected to the turbine disk between two moving blades, the number of required platform parts and holding devices for the platform parts is lowered respectively to one platform part and one holding device between two adjacent moving blades in each case.

The largest possible surface fraction of the platform part is achieved in that the platform part is inserted between the end regions of two adjacent blade profiles in such a way that it replaces the platforms virtually completely. Almost the entire platform masses are therefore carried by the holding device and do not exert load either on the roots or on the grooves into which the roots are pushed. An optimum mass distribution to the root and the holding device is thus achieved. In the separation regions in which the platform part and the blade are adjacent, a large amount of material and therefore weight is saved, as compared with a one-part construction, since it is no longer necessary to absorb the lever forces occurring due to the large platform part. A great material saving is also made possible by the fact that the edges of the platform part which are adjacent to the blade profiles are shaped in adaptation to the curvature of the blade profiles.

Moreover, production is simplified, since, in this case, the blade has a slender shape, even in the transitional region between the root and profile, this shape being substantially simpler to cast. Stable and at the same time flexible adaption of the holding device to the platform part and to the turbine disk is afforded in that the holding device consists of at least one pairing of holding partners engaging one into the other, at least one connection element which has one holding partner being formed separately from the platform part and from the turbine disk. By the holding partner being formed separately, the platform part can be attached to the turbine disk by way of various methods and so as to be easily exchangeable. Furthermore, various material combinations between the parts are thereby possible.

In particular, the material of a separately formed platform part and of the separately formed holding partner, and also of the turbine disk and the blade, may be different and be selected in a cost-optimized manner, taking into account the respective requirements and loads.

If the holding partner is connected to the turbine disk and to the platform part by form-locking which withstand centrifugal force loads, a holding device of this type can easily be released, for example for repair purposes, and can be reused afterward without any restriction in its functioning.

The holding device can easily be installed and also, in the event of a possible corrosion attack, be removed again at a low outlay when the holding partner is connected with play to the platform part and to the turbine disk. At the same time, in the event of forces being applied from different directions or of a sharply alternating force, the holding device is better suited to reacting flexibly and to being set more easily in the corresponding force direction, with the result that damage to the holding device and the form-locking device connected to it and also to the platform part and the turbine disk is avoided.

Simple attachment is afforded in that one holding partner runs rectilinearly over a coupling length and has a rail-like cross section, and the other holding partner of the pairing runs rectilinearly parallel to the first holding partner and has a cross section surrounding the rail-like cross section of the first holding partner in a form-locking manner. The rail-like construction of the holding partners over the entire coupling length provides large bearing and contact surfaces and therefore good force distribution over the entire region of the coupling. Local stress peaks as a result of the centrifugal forces which act are thus reduced. Particularly in the case of the curved construction of the platform part, the platform part is seated on the turbine disk in a highly reliable way by use of the rail-like holding partners.

A secure hold is afforded when one rail-like holding partner is connected to the platform part and one rail-like holding partner is connected to the turbine disk and both holding partners are connected to two holding partners by way of a connection element, the connection element having an H-shaped cross section surrounding the rail-shaped cross sections in a form-locking manner. The holding partners are connected to one another in a form-locking manner over a large region. The connection is simple to make and can easily be released again. By virtue of the rail-like constructions of the holding partners, the connection element having the H-shaped cross section can easily be pushed in and pulled out between the platform part and the turbine disk. Since no holding partner has a complex shape, they can be produced at a low outlay and cost-effectively.

A highly stable holding device is provided when it is constructed in such a way that the turbine disk has a rail-like holding partner and the platform part has a rail-surrounding holding partner and both are connected by way of a connection element which has a rail-surrounding holding partner and a rail-like holding partner.

BRIEF DESCRIPTION OF THE DRAWINGS

Exemplary embodiments of the invention are illustrated in the figures in which.

DETAILED DESCRIPTION OF THE PREFERRED EMBODIMENTS

Figure 1:
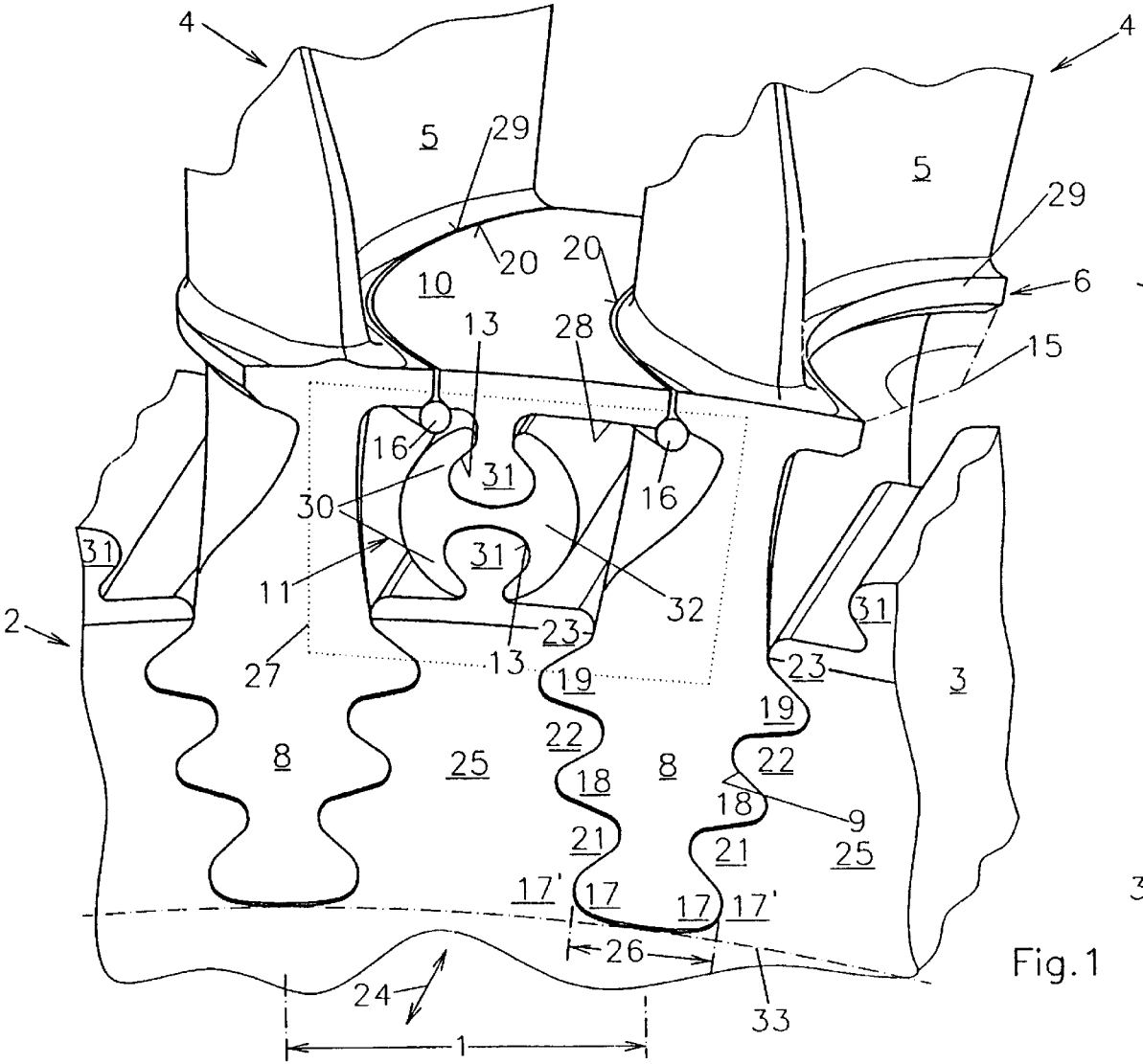
FIG. 1 shows a perspective diagrammatic view of a turbine blade arrangement with a holding device.

FIG. 1 shows a perspective view of a turbine blade arrangement. By way of a hot working fluid, in particular hot gas in the case of a gas turbine, which flows through the turbine and flows against the blade profile 5, a turbine disk 3 having moving blades 4 is driven to rotate about a turbine axis 24. The moving blades 4 are inserted with pinetree-like roots 8 into grooves 9 at an interval 1 in the outer circumference 2 of the turbine disk 3 by being pushed in laterally. As a result of rotational movements of the turbine disk 3, the moving blades 4 are loaded by an outwardly directed centrifugal force. This centrifugal force is absorbed by the root 8 of the moving blade 4 and the claws 25 of the turbine disk 3 by way of various teeth 17,18,19,21,22,23 which are shaped in a pinetree-like manner on the root 8 and have in the claw 25 the integrally shaped portions corresponding to them. Illustrated by way of example are the lowest root teeth 17 on both sides of the root 8, which are held by the lowest claw teeth 21 of the claws 25, middle root teeth 18, again on both sides of the root 8, which engage behind the corresponding middle claw teeth 22, and uppermost root teeth 19 which are located nearest the surface of the turbine disk 3 and engage behind uppermost claw teeth 23. The root 8 becomes increasingly thicker in diameter 26 from the lower root tooth 17 as far as the uppermost root tooth 19. The centrifugal forces occurring as a result of the rotation of the disk 3 and of the moving blades 4 attached to the latter can be absorbed in this way.

In the case of very long moving blades 4, however, recesses 17' in the claw 25 which receive the lowest root teeth 17, because of the high local forces taking effect there, particularly in the region of a root cut 33, constitute, along the lowest ends of the grooves 9, a boundary for increasing the size of the moving blades 4. This is counteracted in that a part 10 of the platform is connected to the turbine disk 3 by way of the holding device 11 so as to withstand centrifugal force stress. A platform, like the platform part 10 present here too, serves, in general, for protecting the root region against being heated up by working fluid, in particular hot gas, flowing past.

The platform part 10 is inserted separately between two moving blades 4 in each case. The holding device 11 consists, in this case, of two rail-like holding partners 31 and of a connection element 32. The rail-like holding partners 31 are in each case attached to the outer circumference 2 of the turbine disk 3, preferably in the middle between two grooves 9 for the blade roots 8, virtually at half the interval 1, and to the platform part 10 on the underside 28 facing the turbine disk 3. The two rail-like holding partners 31 lie parallel to one another and are radially in alignment one above the other. They are connected, by way of the connection element 32 having an H-shaped cross section, to holding partners 30 consisting of rounded recesses 13 into which the holding partners 31 are pushed.

The elements may be produced from different coordinated materials, in particular from a material other than that of the turbine disk 3, for example in order to save costs. Preferably, the holding partners 30, 31 and the connection element 32 are produced in one piece, so that the high forces which act do not find any engagement point for causing damage. The turbine disk consists, for reasons of durability and strength, of special hardened alloys which can be ground only to a restricted extent and can be machined by cutting. In particular, however, it is also possible for the rail-like holding partner 31 running rectilinearly to be produced in one piece with the turbine disk 3. This improves the hold of the holding partner 31 on the turbine disk 3. Engagement points for causing damage due to the centrifugal force load are thereby reduced.

The platform part 10 has a curvature 15 at its two longer edges 20. The curvatures of the edges 20 located on both sides, however, do not necessarily have to be identical. They may be selected in adaptation to the shape of the turbine blade profile cross section. A corresponding curvature 15 is found at the longitudinal-segment edges 29, having a radius, of a cross section of the blade profiles 5 in the end region 6 of the moving blades 4. In this way, even in the case of the curved run of the edges 29, a surface fraction of the platform part 10 which is optimized with respect to the cross-sectional surface of the blade profile 5 in the end region 6 is achieved. This appreciably relieves the groove region.

Figure 4:
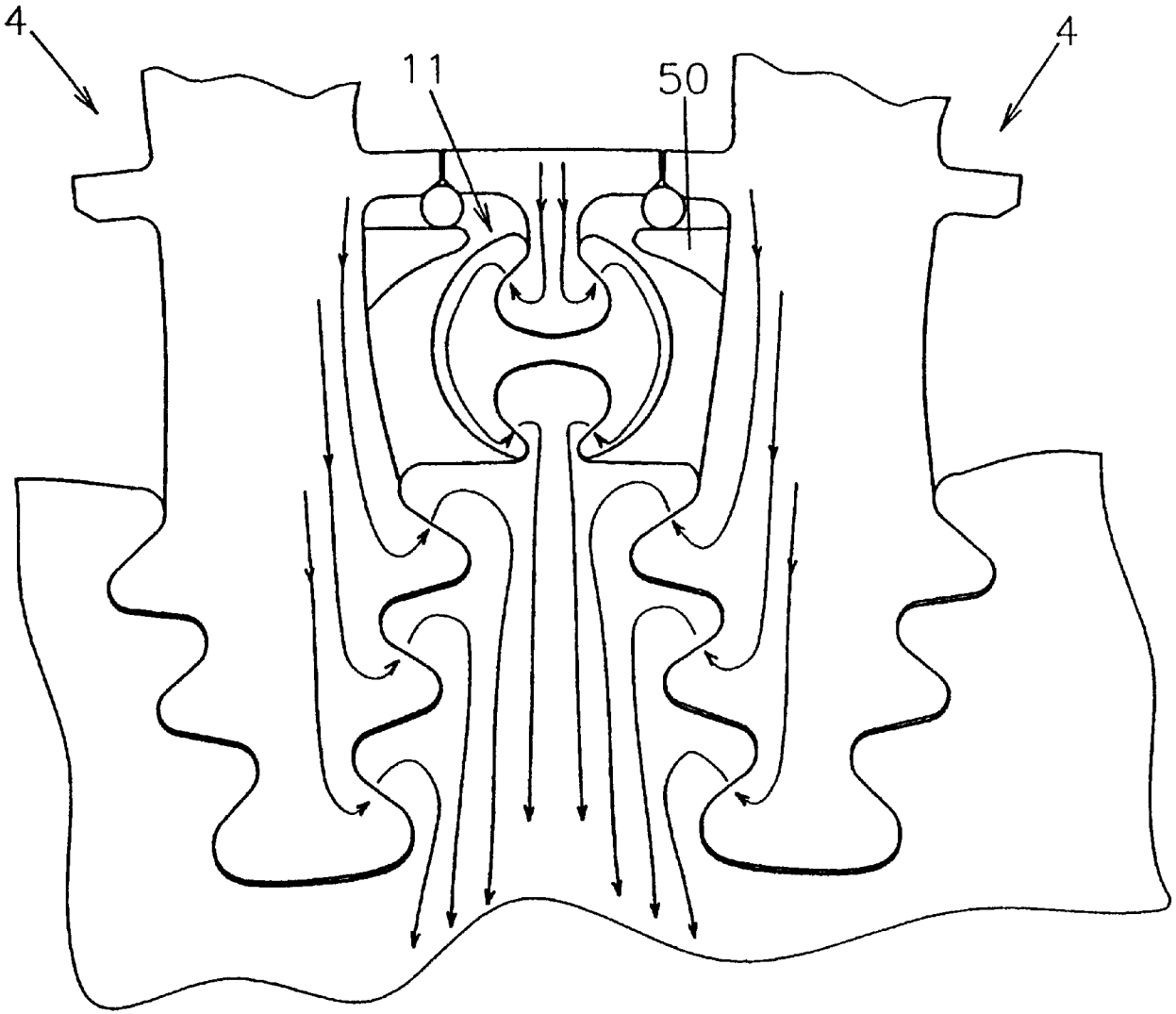
FIG. 4 shows a diagrammatic force distribution illustrated in a side view of the turbine blade arrangement.

Between the platform part 10 and the rest of the moving blade 4, a gap is located between the curved edge 29 and a corresponding edge 20 of the platform part 10. The lower disk-side ends of the gaps are beveled slightly at the two edges 20, 29. Damping wires 16 are laid therein on the underside 28 of the platform part 10. When the turbine disk 3 is at a standstill, the damping wires 16 are held in position by a plurality of fastening bosses 50, as illustrated in FIG. 4. Under centrifugal force load, the damping wires 16 seal off an interspace between platform and turbine disk against the penetration of hot gases through the gap. At the same time, the damping wires 16 damp vibrations in the region of the blade. The damping wires 16 follow the curvature 15 of the platform part 10 and of the moving blade 4. For the easier insertion of the damping wires 16, these are prebent. Moreover, the edges 20, 29 preferably have a corresponding constant curvature 15, so that the damping wires 16 previously provided with a bending radius corresponding to the curvature 15 can easily be pushed in. After the insertion of all the elements, axial sealing plates 27 are placed on end faces of the turbine disk 3 which plates cover preferably virtually the largest part of the end-face disk region from the root top edge to the lower edge of the platform. This prevents working fluid, in particular hot gas, from penetrating laterally under the platforms or the platform parts 10 or to the roots, which would otherwise lead to serious damage there.

Figure 2:
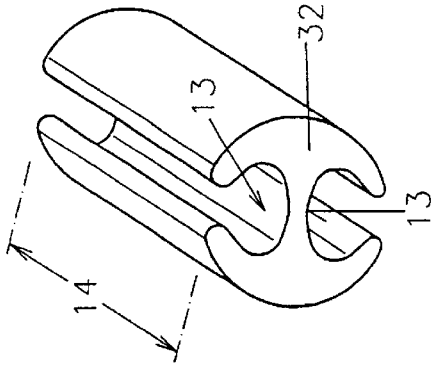
FIG. 2 shows a connection element.

FIG. 2 shows a connection element 32 of H-shaped cross section. The two bays of the H-forming holding partner 30, FIG. 1, run preferably rectilinearly and in the form of recesses 13 in the coupling region 14 which are rounded in a simple way, thus making the production of the elements simpler. The connection element 32 has the same shape and dimensions over its entire cross section. It can thereby be inserted from both sides of the turbine disk.

Figure 3:
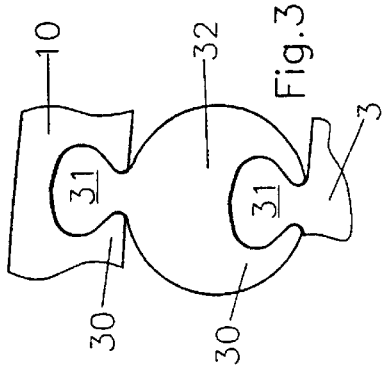
FIG. 3 shows a side view of a holding device.

FIG. 3 shows a further holding device constructed from two pairings of holding partners 30, 31. In this case, the platform part 10 has a holding partner 30 surrounding the rail shape, while, as in the first example too, the turbine disk 3 has a rail-like holding partner 31. The connection element 32 possesses in each case a rail-like holding partner 31 and a rail-surrounding holding partner 30. The connection element 32 can easily be pushed in between the platform part 10 and the turbine disk 3.

FIG. 4 shows a force distribution which occurs as a result of the centrifugal force load within a turbine disk 3 and the inserted moving blades 4 in the case of which the holding technique according to the invention is employed. The maximum knotching stresses are exhibited in the claw region, in particular below the claw teeth 21 in the region of the recesses 17',cf. FIG. 1. A substantial part of the centrifugal force load is transferred directly into the turbine disk 3 via the holding device 11 and does not subject the claw recesses 17' to load. By the holding device 11 being used, average stresses and the stress peaks in the narrowest cross sections or radii of the teeth in the claw region exhibit stress values which float well below values capable of being achieved hitherto. By virtue of the load-optimized division of functional regions of the turbine blade arrangement, the force distribution is thus smoothed out. This makes it possible to have, overall, a higher centrifugal force load which occurs, for example, due to a lengthening of the blade profiles in order to improve efficiency. This lengthening may be carried out both outward, together with an increase in an outer turbine outlet cross section, and inward in the direction of the hub region of the turbine disk.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A turbine blade arrangement, comprising:

at least two movable blades, a root portion of each blade being insertable into a groove of a turbine disk, and a blade profile portion of each blade extending from the turbine disk;

a platform, located between the at least two movable blades, wherein at least a part of the platform is connected to the turbine disk by way of a holding device; and at least a pair of damping wires, located between the platform and the turbine disk and formed separate from the holding device adapted to dampen the platform and adapted to block gas from penetrating a space between the platform and the turbine disk.

2. The turbine blade arrangement as claimed in claim 1, wherein the platform part connected to the turbine disk by way of the holding device is produced separately from the movable blade.

3. The turbine blade arrangement as claimed in claim 2, wherein a one-piece platform part is used as the platform part of two adjacent movable blades, and the holding device is arranged approximately in the middle between the two adjacent movable blades.

4. The turbine blade arrangement as claimed in claim 2, wherein the platform part is inserted between end regions of the blade profiles of two adjacent movable blades in such a way as to thereby substantially replace the platforms.

5. The turbine blade arrangement as claimed in claim 2, wherein the holding device includes at least one pairing of holding partners engaging one into the other, at least one connection element of the holding device including at least one holding partner formed separately from the platform part and from the turbine disk.

6. The turbine blade arrangement as claimed in claim 1, wherein a one-piece platform part is used as the platform part of two adjacent movable blades, and the holding device is arranged approximately in the middle between the two adjacent movable blades.

7. The turbine blade arrangement as claimed in claim 6, wherein the platform part is inserted between end regions of the blade profile portions of two adjacent movable blades in such a way as to thereby substantially replace the platforms.

8. The turbine blade arrangement as claimed in claim 6, wherein the holding device includes at least one pairing of holding partners engaging one into the other, at least one connection element of the holding device including at least one holding partner formed separately from the platform part and from the turbine disk.

9. The turbine blade arrangement as claimed in claim 1, wherein the platform part is inserted between end regions of the blade profile portions of two adjacent movable blades in such a way as to thereby substantially replace the platforms.

10. The turbine blade arrangement as claimed in claim 9, wherein the holding device includes at least one pairing of holding partners engaging one into the other, at least one connection element of the holding device including at least one holding partner formed separately from the platform part and from the turbine disk.

11. The turbine blade arrangement as claimed in claim 1, wherein the holding device includes at least one pairing of holding partners engaging one into the other, at least one connection element of the holding device including at least one holding partner formed separately from the platform part and from the turbine disk.

12. The turbine blade arrangement as claimed in claim 11, wherein the holding partner of the at least one connection element is connected to the turbine disk and to the platform part by centrifugal force load withstanding form-locking.

13. The turbine blade arrangement as claimed in claim 12, wherein at least one holding partner includes a rail-like cross section, and at least one other holding partner includes a cross section surrounding the rail-like cross section of the at least one holding partner in a form-locking manner.

14. The turbine blade arrangement as claimed in claim 11, wherein the at least one holding partner of the at least one connection element is connected with play to the platform part and to the turbine disk.

15. The turbine blade arrangement as claimed in claim 14, wherein at least one holding partner includes a rail-like cross section, and at least one other holding partner includes a cross section surrounding the rail-like cross section of the at least one holding partner in a form-locking manner.

16. The turbine blade arrangement as claimed in claim 11, wherein at least one holding partner includes a rail-like cross section, and at least one other holding partner includes a cross section surrounding the rail-like cross section of the at least one holding partner in a form-locking manner.

17. The turbine blade arrangement as claimed in claim 16, wherein one rail-like holding partner is connected to the platform part and one rail-like holding partner is connected to the turbine disk, and wherein both rail-like holding partners are each respectively connected to another two respective holding partners of a connection element, the connection element having an H-shaped cross section surrounding the rail-like holding partners in a form-locking manner.

18. The turbine blade arrangement as claimed in claim 16, wherein the turbine disk has a rail-like holding partner and the platform part has a rail-surrounding holding partner, and both are connected by way of a connection element which has a rail-surrounding holding partner and a rail-like holding partner.

19. A turbine blade arrangement, comprising:

at least two movable blades, a root portion of each blade being insertable into a groove of a turbine disk, and a blade profile portion of each blade extending from the turbine disk; and a platform, located between the at least two movable blades, wherein at least a part of the platform is connected to the turbine disk by way of a holding device, wherein the holding device includes at least one pairing of holding partners engaging one into the other, at least one connection element of the holding device including at least one holding partner, the at least one holding partner being formed separately from the platform part and from the turbine disk and connected with play to the platform part and to the turbine disk.

20. A turbine blade arrangement, comprising:

at least two movable blades, a root portion of each blade being insertable into a groove of a turbine disk, and a blade profile portion of each blade extending from the turbine disk; and a platform, located between the at least two movable blades, wherein at least a part of the platform is connected to the turbine disk by way of a holding device, wherein the holding device includes at least one pairing of holding partners engaging one into the other, at least one connection element of the holding device including at least one holding partner, the at least one holding partner being formed separately from the platform part and from the turbine disk, wherein at least one holding partner includes a rail-like cross section, and at least one other holding partner includes a cross section surrounding the rail-like cross section of the at least one holding partner in a form-locking manner, wherein one rail-like holding partner is connected to the platform part and one rail-like holding partner is connected to the turbine disk, and wherein both rail-like holding partners are each respectively connected to another two respective holding partners of a connection element, the connection element having an H-shaped cross section surrounding the rail-like holding partners in a form-locking manner.

21. A turbine blade arrangement, comprising:

at least two movable blades, a root portion of each blade being insertable into a groove of a turbine disk, and a blade profile portion of each blade extending from the turbine disk; and a platform, located between the at least two movable blades, wherein at least a part of the platform is connected to the turbine disk by way of a holding device, wherein the holding device includes at least one pairing of holding partners engaging one into the other, at least one connection element of the holding device including at least one holding partner, the at least one holding partner being formed separately from the platform part and from the turbine disk, wherein at least one holding partner includes a rail-like cross section, and at least one other holding partner includes a cross section surrounding the rail-like cross section of the at least one holding partner in a form-locking manner, and wherein the turbine disk has a rail-like holding partner and the platform part has a rail-surrounding holding partner, and both are connected by way of the connection element which has a rail-surrounding holding partner and a rail-like holding partner.

* * * * *